US011066848B2

(12) United States Patent
Romero

(10) Patent No.: US 11,066,848 B2
(45) Date of Patent: Jul. 20, 2021

(54) PUSH TO LOCK AND UNLOCK DOOR LOCK

(71) Applicant: Spectrum Brands, Inc., Middleton, WI (US)

(72) Inventor: Oscar Romero, Lake Forest, CA (US)

(73) Assignee: Spectrum Brands, Inc., Middleton, WI (US)

( * ) Notice: Subject to any disclaimer, the term of this patent is extended or adjusted under 35 U.S.C. 154(b) by 691 days.

(21) Appl. No.: 15/702,698

(22) Filed: Sep. 12, 2017

(65) Prior Publication Data

US 2018/0073271 A1 Mar. 15, 2018

Related U.S. Application Data

(60) Provisional application No. 62/393,369, filed on Sep. 12, 2016.

(51) Int. Cl.

| | |
|---|---|
| ***E05B 13/10*** | (2006.01) |
| ***E05B 55/00*** | (2006.01) |
| ***E05B 1/00*** | (2006.01) |
| ***E05B 15/00*** | (2006.01) |
| *E05B 9/04* | (2006.01) |

(52) U.S. Cl.

CPC ..... *E05B 13/105* (2013.01); *E05B 1/0007* (2013.01); *E05B 13/108* (2013.01); *E05B 15/0033* (2013.01); *E05B 55/005* (2013.01); *E05B 2009/046* (2013.01)

(58) Field of Classification Search

CPC ..... E05B 1/00; E05B 1/003; E05B 1/0038; E05B 13/002; E05B 13/004; E05B 13/10; E05B 13/105; E05B 15/0053; E05B 15/006; E05B 2063/0082; E05B 2009/046; E05B 13/108; E05B 15/0033; E05B 55/005; E05B 1/0007; E05C 19/02; E05C 19/022; Y10T 292/0876; Y10T 292/57; Y10T 292/0863; Y10T 292/0864; Y10T 292/0867; Y10T 292/0868; Y10T 292/0877; Y10T 292/93;

(Continued)

(56) References Cited

U.S. PATENT DOCUMENTS 2,497,328 A * 2/1950 Smith ..... E05B 55/005 292/169.18
2,672,041 A * 3/1954 Heyer ..... E05B 55/005 70/223

(Continued)

FOREIGN PATENT DOCUMENTS

DE 3943291 A1 * 7/1991 ..... E05B 13/108
EP 0085586 A1 * 8/1983 ..... E05B 1/0038

(Continued)

*Primary Examiner* — Christine M Mills
(74) *Attorney, Agent, or Firm* — Merchant & Gould P.C.

(57) ABSTRACT

A door locking mechanism is contained within a cartridge for use with a tubular style door lock. The cartridge activates and deactivates the door lock with a manual depression of a push button. Depressing the push button causes a cam to rotate thus converting the axial motion of the push button into a rotary motion thereby activating the door lock. Once locked, both the interior and exterior door knobs may not be rotated. In order to unlock the door, the push button is depressed a second time thereby rotating the cam in an opposing direction and deactivating the door lock.

17 Claims, 15 Drawing Sheets

(58) Field of Classification Search
CPC .... Y10T 292/96; Y10S 292/04; Y10S 292/30; Y10S 292/37
USPC ..... 292/70, 336.3, DIG. 4, DIG. 30, 57, 58, 292/60, 61, 71, 358, 359; 70/152, 482
See application file for complete search history.

(56) References Cited

U.S. PATENT DOCUMENTS 2,747,907 A * 5/1956 Golden ..... E05B 55/005 292/169.18
3,105,712 A * 10/1963 Duvall ..... E05C 1/163 292/169.17
3,580,622 A * 5/1971 Morgan ..... E05C 1/163 292/169
3,858,918 A * 1/1975 McBurnie ..... E05C 1/163 292/169.15
4,169,618 A * 10/1979 Potter ..... E05C 1/163 292/169.15
6,139,072 A * 10/2000 Lee ..... E05B 13/101 292/168
6,860,529 B2 * 3/2005 Chong ..... E05B 13/002 292/169.18
6,926,315 B2 * 8/2005 Kondratuk ..... E05C 1/14 292/165
7,934,754 B2 * 5/2011 Mathachan ..... E05B 13/002 292/336.3
8,505,345 B2 * 8/2013 Sun ..... E05B 13/108 70/223
9,121,200 B2 * 9/2015 Weathersby ..... E05C 1/14
2003/0126896 A1 * 7/2003 Mori ..... E05B 37/16 70/214
2009/0033107 A1 * 2/2009 Zimmer ..... E05B 15/0086 292/302
2017/0122002 A1 * 5/2017 Morse ..... E05B 63/0069
2017/0218659 A1 * 8/2017 Chong ..... E05B 63/0069

FOREIGN PATENT DOCUMENTS

GB 339843 A * 12/1930 ..... E05B 55/005
GB 791769 A * 3/1958 ..... E05B 55/005

* cited by examiner (Section AA)

PUSH TO LOCK AND UNLOCK DOOR LOCK

REFERENCE TO EARLIER APPLICATIONS

This application claims priority to U.S. Provisional Application Ser. No. 62/393,369 filed on Sep. 12, 2016, the entire contents of which are expressly incorporated herein by reference.

TECHNICAL FIELD

The present invention relates to door locks. More particularly it relates to tubular style door locks for door knobs and levers.

BACKGROUND OF INVENTION

Doors are commonly equipped with knobs and levers to provide a convenient means to secure the door in a closed position. This may be done with a retractable latch that extends from the side of the door and into the latch jamb through a strike plate when the door is closed. In order to retract the latch and allow the door to be opened again, the door handle or knob may be turned which in turn retracts the latch.

Releasing the door handle typically allows a return spring to bring the latch back into the extended position. For an added level of privacy, a lock is commonly added to the door knob or lever that prevents actuation of the latch when the lock is activated. The lock is commonly actuated and engaged by depressing a push button on the interior side of the door handle or knob.

In order to disengage the lock, the interior door lever or knob is typically rotated which then allows the latch to be retracted by either the interior or exterior door lever or knob. A key hole may also be added to the exterior door handle or knob allowing a key or similar tool to be used to disengage the lock from the exterior side of the door.

One problem associated with this known configuration is that often times a user inadvertently disengages the lock by rotating the interior handle. The user also commonly confirms that the lock is engaged by rotating the interior lever or knob thus disengaging the lock if it was engaged. What is therefore needed is a door lock that can be both engaged and disengaged by depressing the same button. What is also needed is a door lock that is not disengaged by rotating the interior or exterior door lever or knob.

OBJECTS AND SUMMARY OF THE INVENTION

A door lock may be operated by rotating either a knob or a lever, depending on the style of entry, on either the interior side or the exterior side of a door. Rotation of the knob or lever retracts the latch and allows the door to be pivoted about the hinge to close the door. Closing the door aligns the latch with an opening in the strike mounted in the door frame.

Releasing the one of the knob and the lever thereby allows the latch to extend into the opening of the strike in the door frame thus securing the door in the closed position. For added security, actuating a lock mechanism a first time activates a lock and secures the latch, thereby preventing rotation of the one of the knob and the lever on both the interior side and the exterior side of the door to retract the latch.

In order to deactivate the lock, the lock mechanism may be actuated a second time thereby allowing rotation of the one of the knob and the lever on the interior and exterior to retract the latch from the opening of the strike in the door frame.

In order to actuate the lock, a button on the one of the knob and the lever may be depressed, preferably on the interior side of the door. Simply rotating the one of the knob and the lever, on either the interior or exterior, does not disengage the lock. In order to disengage the lock, the button must depressed a second time.

The lock may also be in the form of a retrofittable cartridge configured for retrofitting with existing door hardware. The latch and lock is also preferably made to work with a tubular style lock, but other applications such as a mortise lock are also envisioned to be compatible.

In operation, the door lock can be activated by actuating the lock mechanism the first time, i.e., pressing the push button a first time, thereby securing the latch and preventing rotation of the one of knob and lever on both the interior side and the exterior sides of the door. To deactivate the door lock, the push button is depressed a second time, which allows the one of the knob and the lever to rotate and retract the latch.

The push button extends from the one of the knob and the lever in a first extended position when the door lock is activated and in a second extended position when the door lock is deactivated. The second extended position is greater than the first extended position, meaning it extends further from the one of the door knob and the lever.

The door lock is made up of a number of parts. Primarily, a lock cartridge within the door handle activates a lock mechanism and deactivates the lock mechanism with a manual depression of a push button within the lock cartridge. A spring in mechanical engagement with the push button returns the push button following the manual depression. When the push button is depressed, a cylindrical cam within an open end of the push button rotates. The cam rotates as it is displaced by a retainer pin passed through a retainer hole in the push button, thereby maintaining the retainer pin in a single location with respect to the push button. The cam includes a cutout along the side of the cam such that the retainer pin urges the cam to rotate within the push button along the cutout as the cam is displaced by the retainer pin.

The cutout along the side of the cam defines a first pathway establishing a route for the retainer pin to travel as the push button is manually depressed a first time, thus rotating the cam. After the retainer pin travels the length of the first pathway, it is retained within a pocket on the first pathway that retains the guide pin. When the push button is depressed a second time, the retainer pin moves along a second pathway defining a distinct route for the guide pin to travel, thus rotating the cam in an opposing direction with respect to the first pathway. As a result, the lock mechanism is engaged following the first time the push button is manually depressed and disengaged following the second time the push button is manually depressed.

The rotational action of the cam is transferred to a locking spindle in engagement with the cam, thereby selectively activating the door lock as the locking spindle is rotated. When the push button is depressed a second time, the locking spindle rotates again to deactivate the door lock.

The locking spindle includes a forked end on a first side and an opposing side configured to interlock with a hole in the cam, thereby rotating the locking spindle as the cam is rotated. A detent tab is contained within the push button such that the cam is between the detent tab and the spring. The locking spindle engages the cam through an opening in the detent tab.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
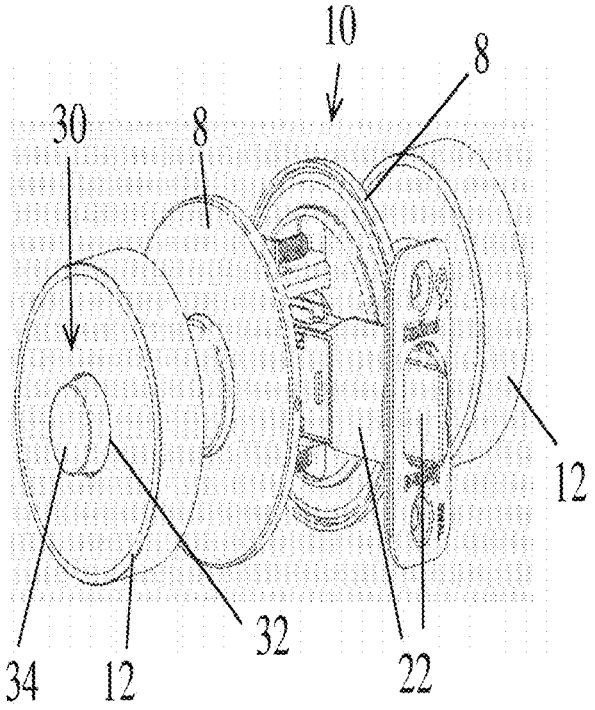
FIG. 1 is a perspective view of a door knob incorporating an embodiment of a push to lock and unlock cartridge.
Figure 2:
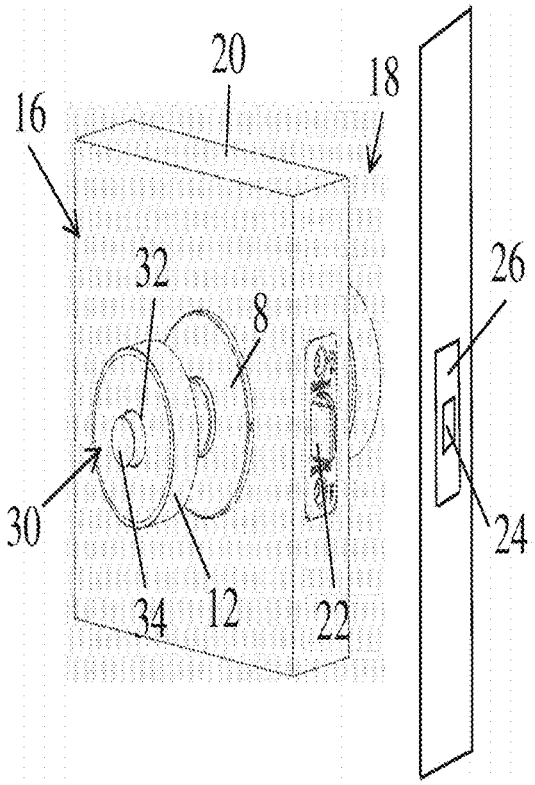
FIG. 2 is a perspective view of the push to lock and unlock cartridge of FIG. 1 installed in a typical door.

FIGS. 1 and 2 show a door lock 10 incorporating a lock mechanism 30 according to the invention. The lock mechanism 30 is inserted into a knob 12 and extends through an opening 32 in the knob 12. A push button 34 may be manually depressed by a user to activate and deactivate the door lock 10. The door lock 10 operates a conventional latch 22 and may be trimmed with a conventional rose 8. While a knob 12 is shown, the door lock 10 may also be configured to work with a lever and the term "knob" is used interchangeably with "lever". The door lock is inserted through a central opening 32 of the knob 12, which would be the same in a lever configuration.

Figure 3:
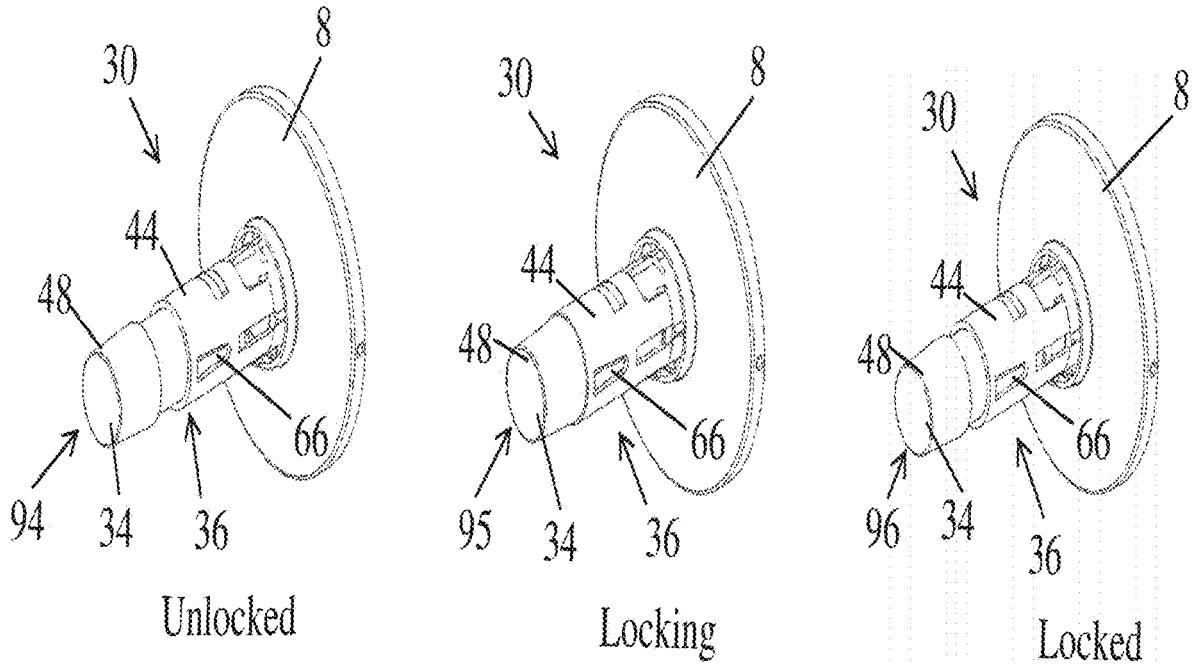
FIG. 3 is a multi-perspective view of a push to lock and unlock cartridge at various phases of operation.

Moving on to FIG. 3, a cartridge 36 is shown extending from the rose 8. The knob 12 is removed to allow an unobstructed view of the lock mechanism 30, which primarily includes the cartridge 36. The lock mechanism 30 is shown in three different operating states. In order to activate the lock mechanism 30, a closed end 48 of the push button 34 is manually depressed. Manually depressing the push button 34 moves the push button 34 from a first extended position 94 as seen on the left, to a depressed position 95 as seen in the middle. Once the manual depression pressure is removed from the closed end 48 of the push button 34, the push button 34 slightly rebounds and is maintained in a locked state with the lock mechanism 30 activated. As shown on the right, the push button 34 is slightly extended in a second extended position 96 between the first extended position 94 and the depressed position 95 when the lock mechanism 30 is activated.

Figure 4A:
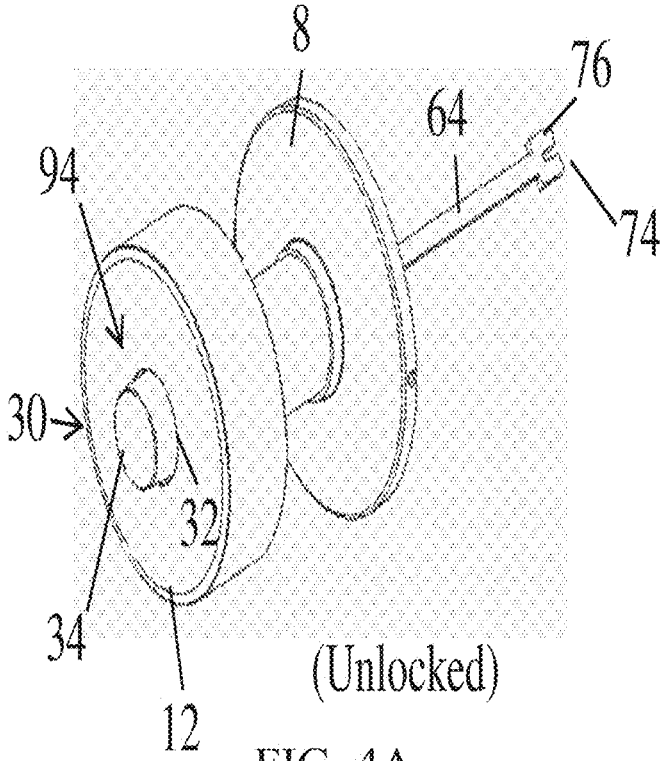
FIGS. 4A and 4B are a multi-perspective view of a door knob fitted with the cartridge of FIG. 3 in various stages of operation.
Figure 4B:
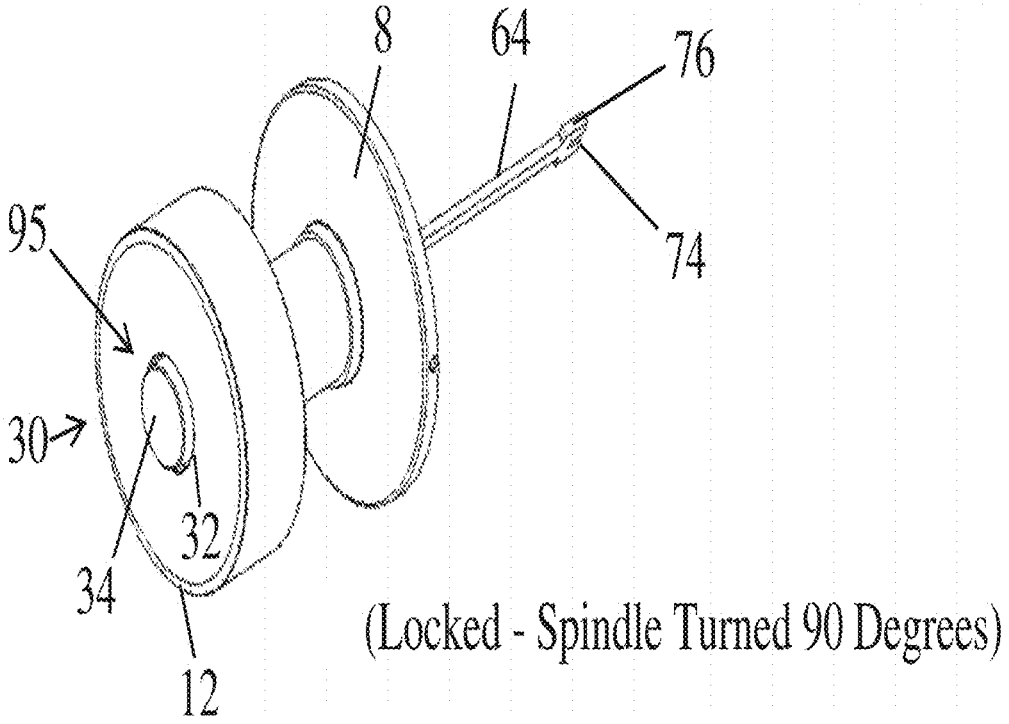

When the push button 34 is depressed and released, cycling between the first extended position 94, depressed position 95, and the second extended position 96, the cartridge 36 rotates a locking spindle 64 to activate and deactivate the lock mechanism 30, as shown in FIGS. 4A and 4B.

FIG. 4A shows the locking spindle 64 in an unlocked position with the push button in the first extended position. The locking spindle 64 transfers rotary motion from the cartridge 36 of the lock mechanism 30 to a door knob or lever on an exterior side of the door (not pictured) thus engaging a lock and preventing both the exterior and the interior knob 12 from rotating. Preferably, the locking spindle 64 connects to the exterior side knob on a first side 76 of the locking spindle with a forked end 74. Any other attachment mechanisms are foreseen and are acceptable as well. The overall goal of the locking spindle is simply to transfer the rotary motion of the lock mechanism 30 from the push button 34 on the interior knob 12 to the exterior side knob to engage the lock.

After the push button 34 is depressed and released by a user, the push button 34 slightly rebounds and remains in the depressed position 95 shown in FIG. 4B. Once the lock mechanism 30 is in the locked state as shown in FIG. 4B, the locking spindle 64 is rotated 90 degrees as opposed to when the lock mechanism 30 is in the unlocked state as shown in FIG. 4A. The rotational movement of the locking spindle 64 is transferred by the first side 76 to engage the door knob on the exterior side of the door with the forked end 74 and lock the door.

Figure 5:
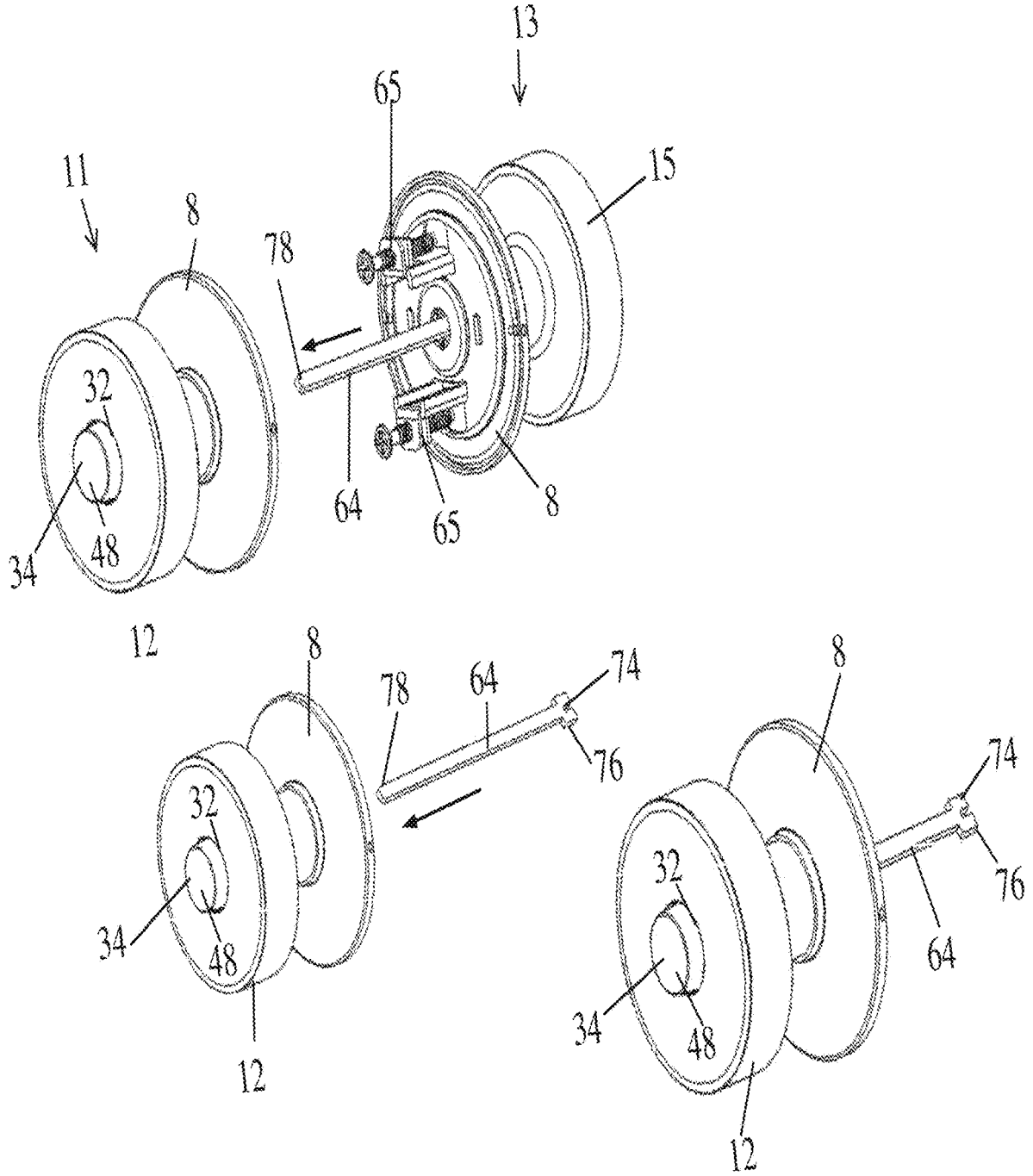
FIG. 5 is a multi-perspective view of a locking spindle transferring motion from the push to lock and unlock cartridge of the door knob of FIG. 1.

FIG. 5 shows an example of an interior 11 knob 12 and an exterior 13 knob 15 in a partially exploded view. Only the interior 11 knob 12 has a push button 34 extending from an opening 32 on the knob 12. The exterior 13 knob 15 may be locked by rotating the locking spindle 64 through manual depression of the push button 34 on the interior 11. The exterior 13 knob 15 may be fastened to the door with door knob fasteners 65 or the like. Similar fasteners may also be used to retain the interior 11 knob 12 to the door. The locking function is only activated through depression of the push button 34 on the interior 11 knob 12. The axial displacement from pushing the push button 34 is converted to a rotary motion of the locking spindle 64 by the internals of the cartridge 36. The locking spindle 64 is rotated as an opposing side 78 of the locking spindle 64 is joined to a cam 54, as shown in FIG. 6 for example.

Figure 6:
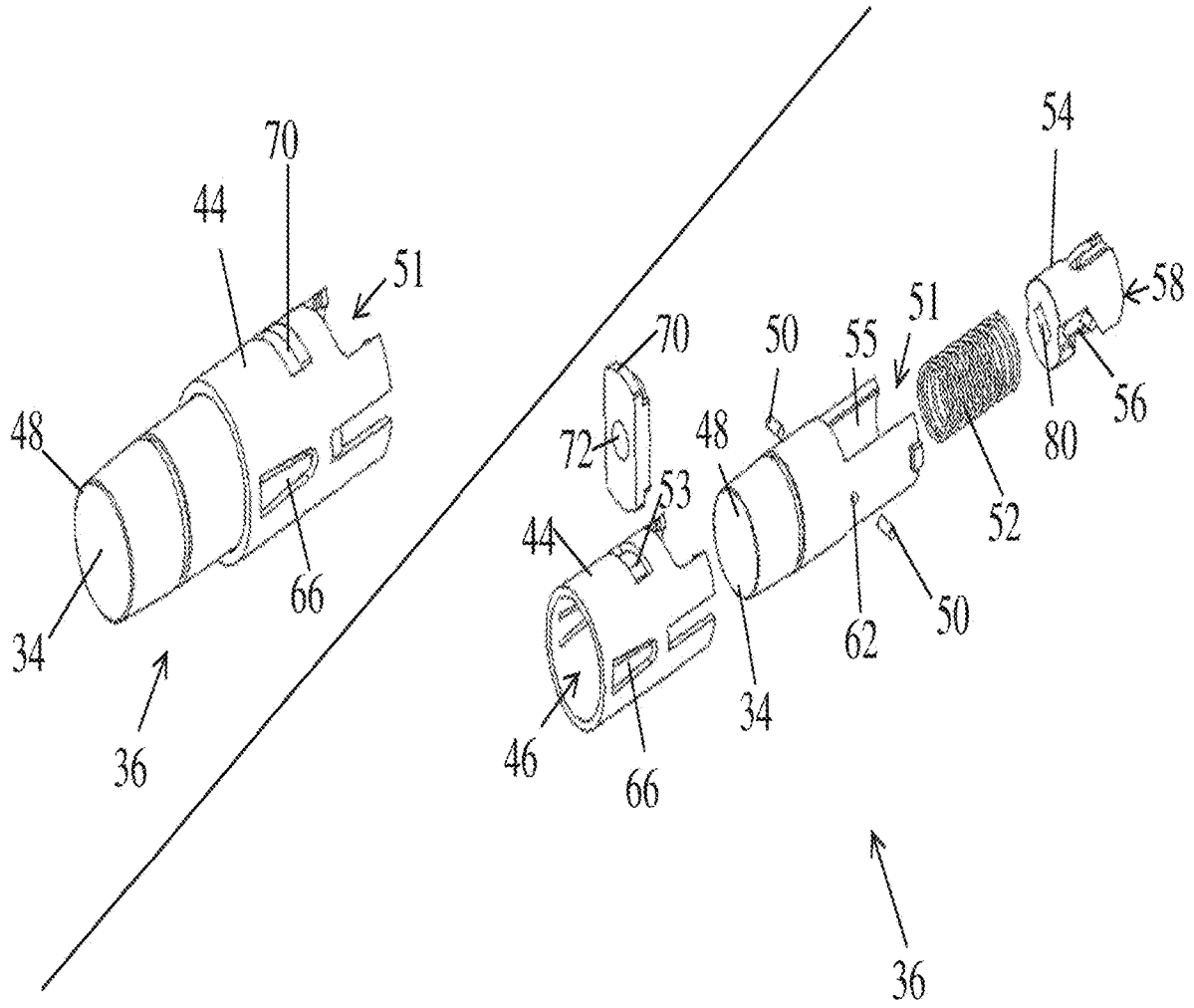
FIG. 6 is a perspective view of the push to lock and unlock cartridge in an assembled state and in an exploded state.

FIG. 6 shows the cartridge 36 both in exploded view as well as assembled view. The cartridge 36 includes the push button 34 that moves axially within a body 44. The body 44 has a central bore 46 which receives the closed end 48 of the push button 34. The axial motion generated by depressing the push button 34 is converted into rotary motion by the cam 54, a spring 52, a detent tab 70, and retainer pins 50.

The closed end 48 of the push button 34 is inserted into the central bore 46 of the body 44. The spring 52 is then loaded into an open end 51 of the push button 34. The spring 52 maintains an axial force on the cam 54 which is inserted into the open end 51 of the push button 34 following the spring 52. The detent tab 70 is inserted through a slot 53 on the body 44 and rides in a channel 55 of the push button 34. The detent tab 70 contains the spring 52 and cam 54 within the push button 34. The cam 54 is pressed against the detent tab 70 by the spring 52 and thus prevented from substantially moving axially when the push button 34 is depressed.

As the push button 34 is depressed, the spring 52 is further compressed, thus increasing the axial force on the cam 54 and causing slight axial displacement and rotational motion. A set of retainer pins 50 are inserted through retainer holes 62 on the sides of the push button 34 and engage the cam 54 in a sliding relationship. The cam 54 includes a cutout 56 along a side 58. The cutout 56 is formed wrapping around the side 58 of the cam 54 such that both retainer pins 50 are inserted into the cutout 56 on opposing sides. As the push button 34 is depressed, the retainer pins 50 ride within the cutout 56 of the cam 54. Due to the curved nature of the cutout 56, the retainer pins 50 urge the cam 54 to rotate proportionally with the stroke of the push button 34. This rotational motion of the cam 54 is transferred by the previously discussed locking spindle 64, whose opposing side 78 (see FIG. 5) is inserted through a hole 80 in the cam 54 and an opening 72 in the detent tab 70. A pair of leaf springs 66 on the sides of the body 44 maintain inwardly pressure on the retainer pins 50 against the cutout 56 of the cam 54 as the push button 34 is depressed.

Figure 7:
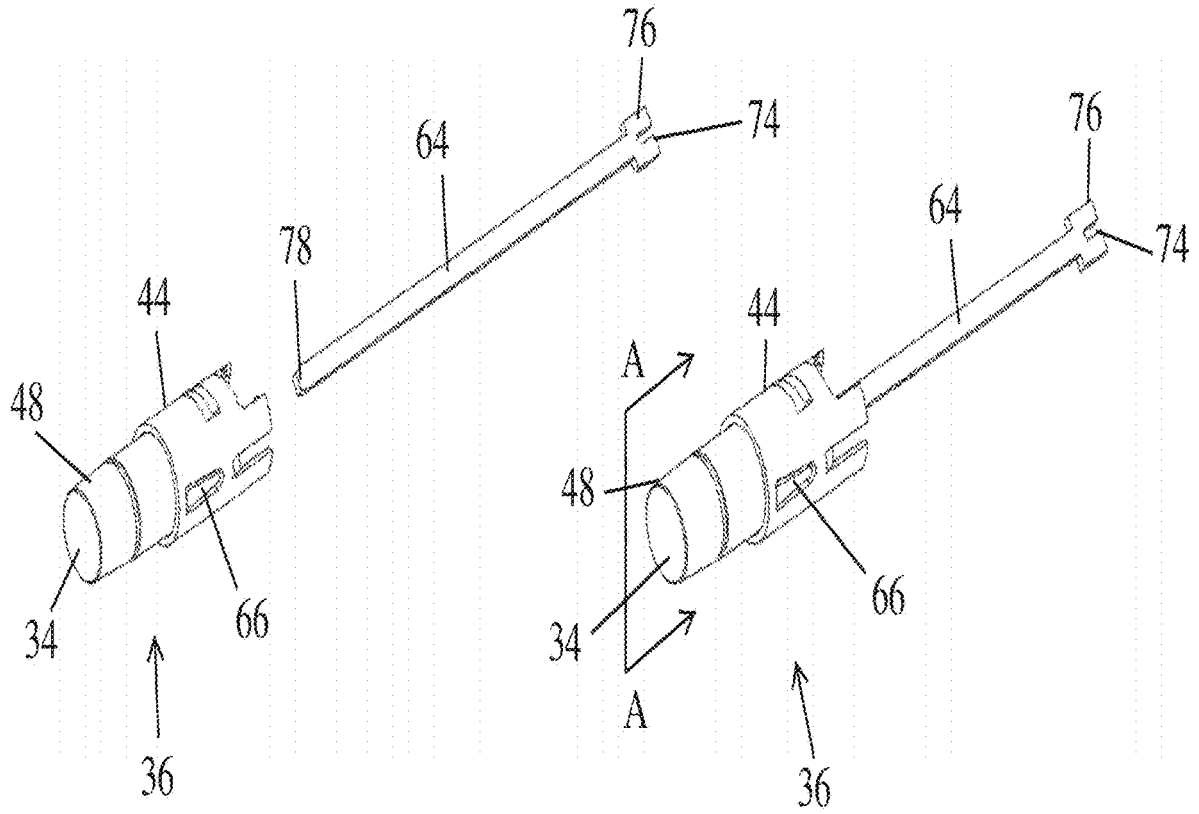
FIG. 7 is a perspective view of the push to lock and unlock cartridge as shown in FIG. 6 with a locking spindle added.

Looking at FIG. 7, the locking spindle 64 is shown both next to the assembled cartridge 36 and installed in the cartridge 36. As previously discussed, the opposing side 78 of the locking spindle 64 is inserted through the opening 72 in the detent tab 70 and into the hole 80 in the cam 54. The hole 80 of the cam 54 is shaped such that any rotary motion of the cam 54 is directly transferred to the locking spindle 64.

Figure 8:
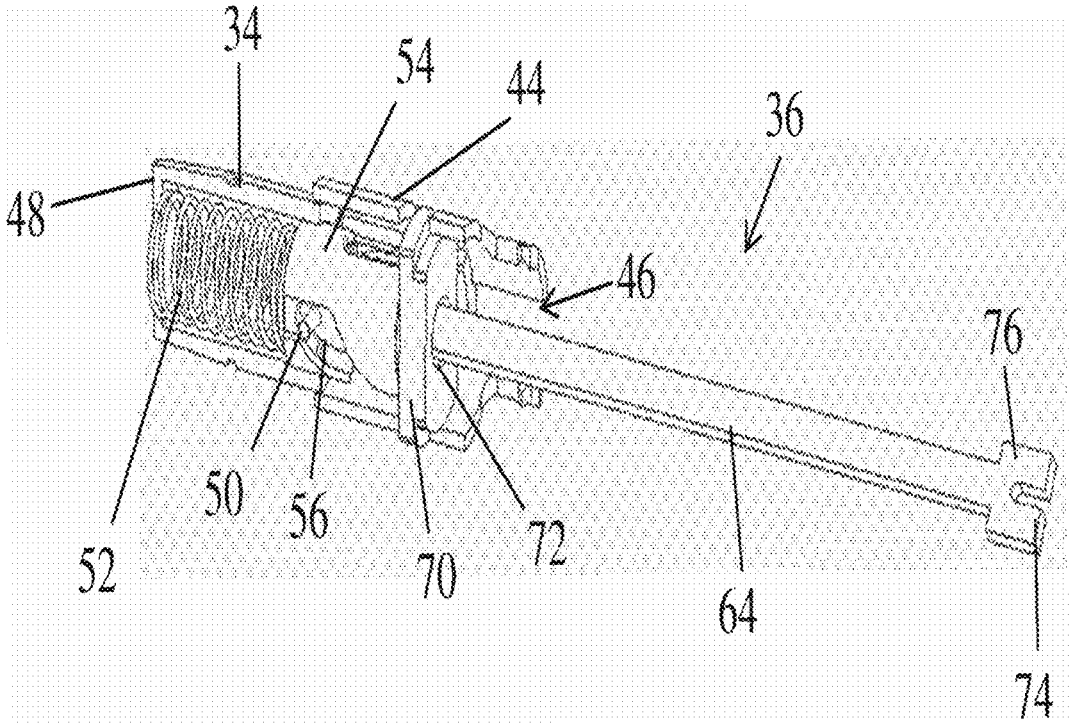
FIG. 8 is a partial cross sectional view of the push to lock and unlock cartridge and locking spindle as shown in FIG. 7 along line AA, showing a push button sectioned with the interior parts whole.
Figure 8:
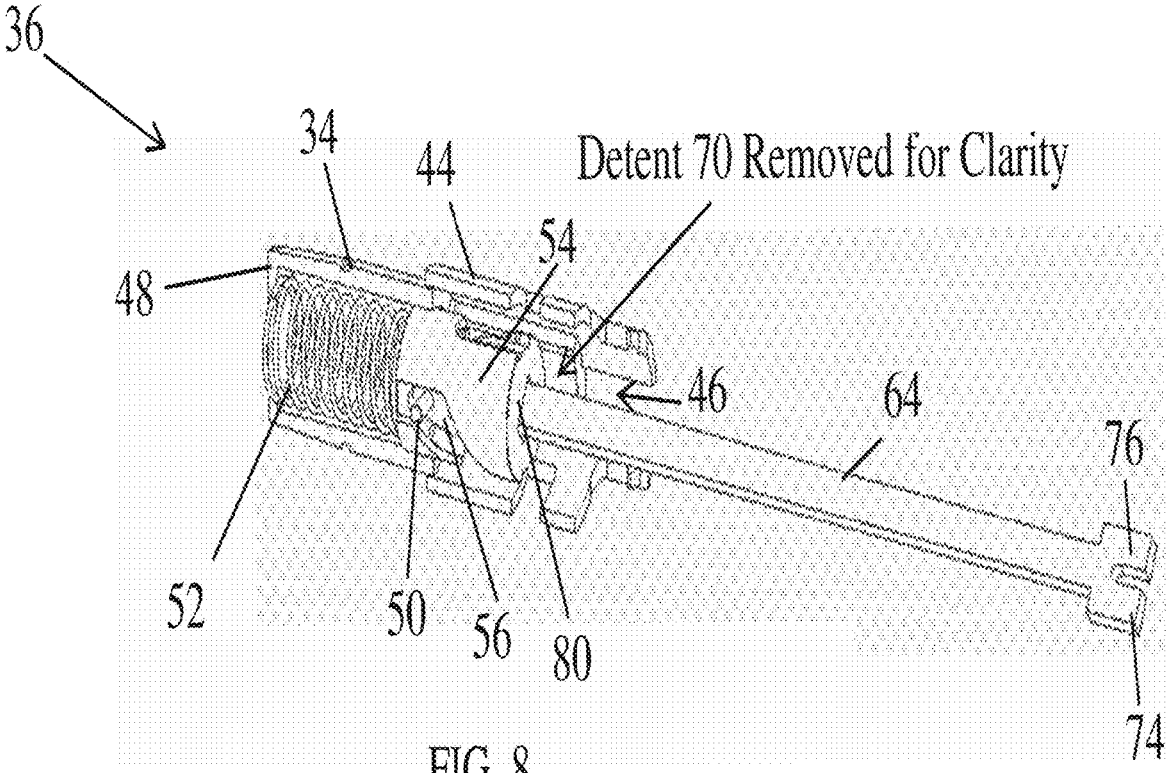

FIG. 8 shows a partial cross sectioned cartridge 36 along line AA from FIG. 7. The cross sectional cut along line AA only removes half of the push button 34 and body 44, thereby exposing the spring 52, cam 54, retainer pins 50 within the cutout 56, and detent tab 70. The locking spindle 64 may also be seen inserted into the opening 72 in the detent tab 70. For clarification, the lower image in FIG. 8 shows the detent tab 72 removed.

Figure 9:
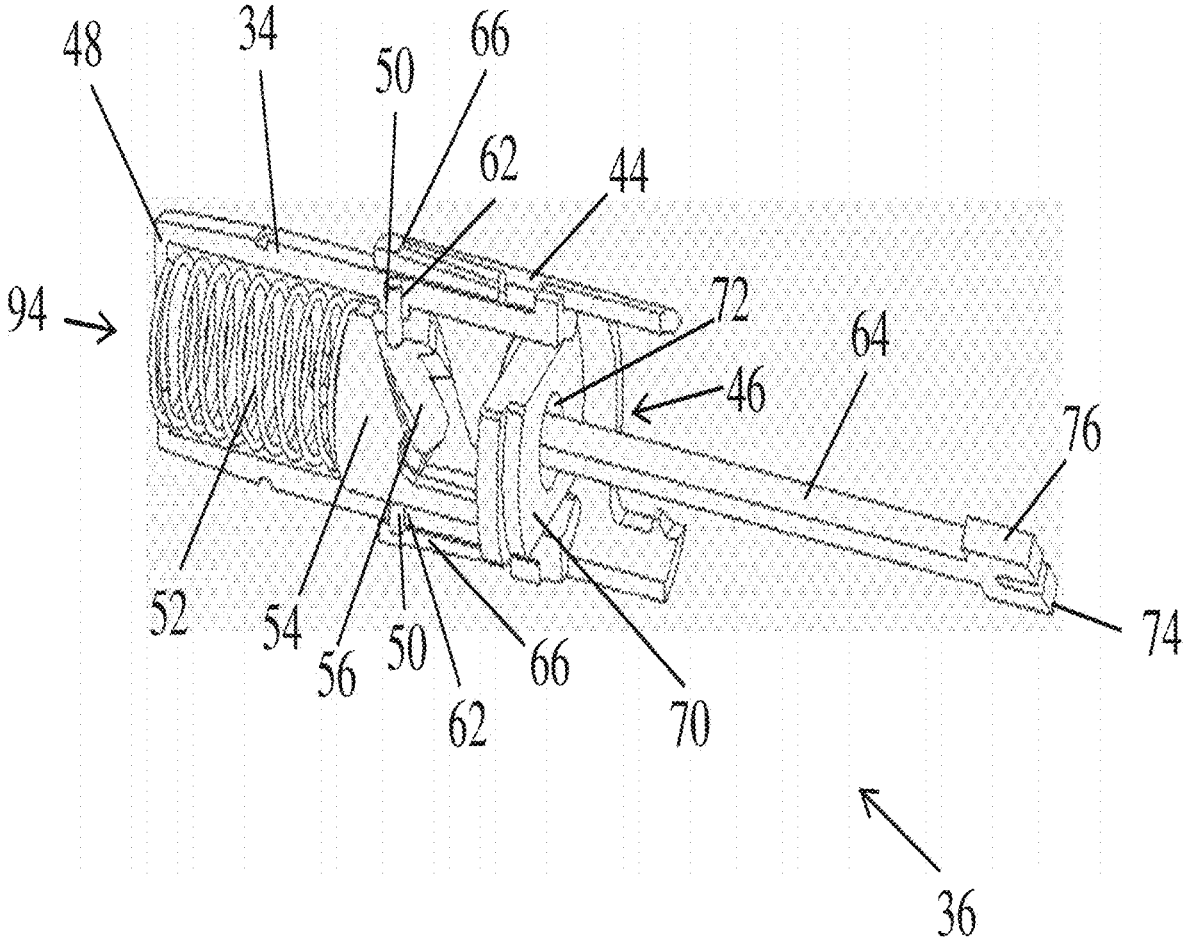
FIG. 9 is a partial cross sectional view of the push to lock and unlock cartridge and locking spindle as shown in FIG. 7 along line AA, showing the push button sectioned with the interior parts whole and a guide pin in the home position.

FIG. 9 shows a similar view of the cartridge 36 as in FIG. 8, but the cross section line is rotated 90 degrees such that the retainer pins 50 are shown interacting with the leaf springs 66. It is important to note that as the push button 34 is depressed, the body 44 remains stationary. The push button 34 is displaced axially within the central bore 46 of the body 44. The retainer pins 50 are also held stationary with respect to the push button 34 as they are simply dowel-shaped pins inserted into holes 62 in the push button 34. The leaf springs 66 maintain pressure on the retainer pins 50 so they remain within the holes 62 and within the cutout 56 of the cam 54.

FIG. 9 also shows the cam 54 and push button 34 in the first extended position 94 as described with respect to FIG. 3. At this point, the lock is not engaged and the door may be operated freely by rotating the knob to retract the latch.

Figure 10:
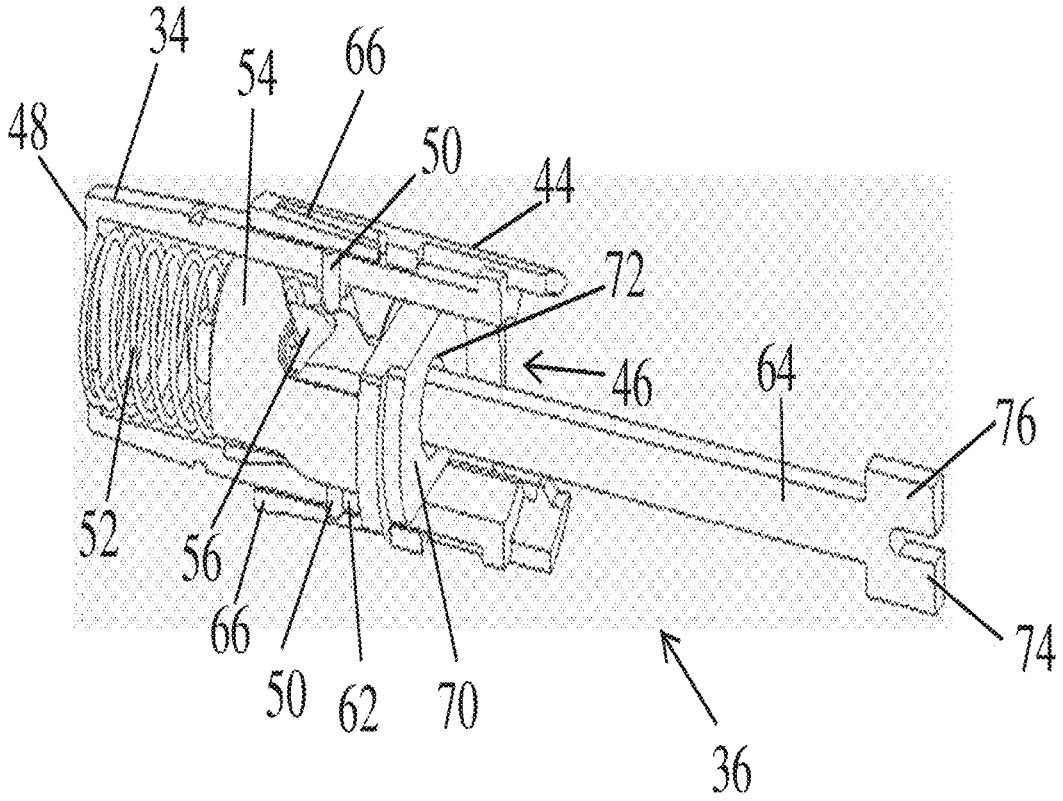
FIG. 10 is a partial cross sectional view of the push to lock and unlock cartridge and locking spindle as shown in FIG. 7 along line AA, showing the push button sectioned with the interior parts whole and the guide pin partially advanced down a first pathway of a cutout as the push button is depressed.

Looking to FIG. 10, the push button 34 is depressed on the closed end 48, the push button 34 slides axially into the body 44 within the central bore 46. The retainer pins 50 remain within the holes in the push button 34 and are continuously urged into the cutout 56 in the cam 54. The retainer pins 50 contact the sidewalls of the cam 54 and as a result, the cam 54 rotates as the retainer pins 50 are axially displaced with the push button 34. The profile of the cutout 56 dictate to what extent the cam 54 rotates. As the cam 54 rotates, the detent tab 70 is locked in place and allows the cam 54 to rotate against it. The locking spindle 64 also rotates along with the cam 54 as they are interconnected.

Figure 11:
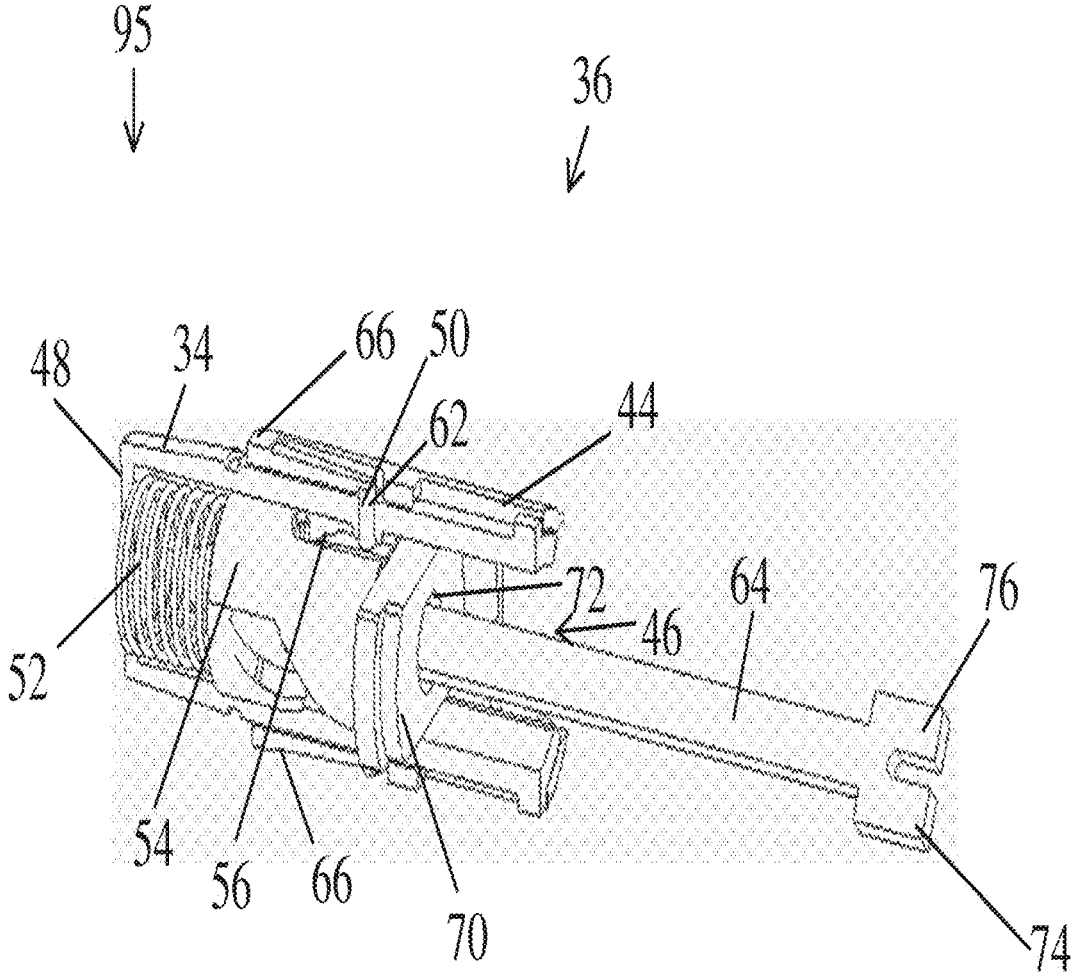
FIG. 11 is a partial cross sectional view of the push to lock and unlock cartridge and locking spindle as shown in FIG. 7 along line AA, showing the push button sectioned with the interior parts whole and the guide pin fully advanced down the first pathway of the cutout as the push button is depressed.

Transitioning now to FIG. 11, the push button 34 is shown fully depressed into the body 44. Due to the curved shape of the cutout 56, the retainer pins 50 have rotated the cam 54 as the push button 34 was depressed into the central bore 46. The curved shape of the cutout 56 therefore interacted with the retainer pins 50 to rotate the locking spindle 64. The retainer pins 50 slide along the length of the leaf springs 66 as the push button 34 is displaced along the axis of the body 44 through the central bore 46. The cam 54 and the locking spindle 64 are now rotated 90 degrees and the push button 34 is in the depressed position 95 as described with respect to FIG. 3.

Figure 12:
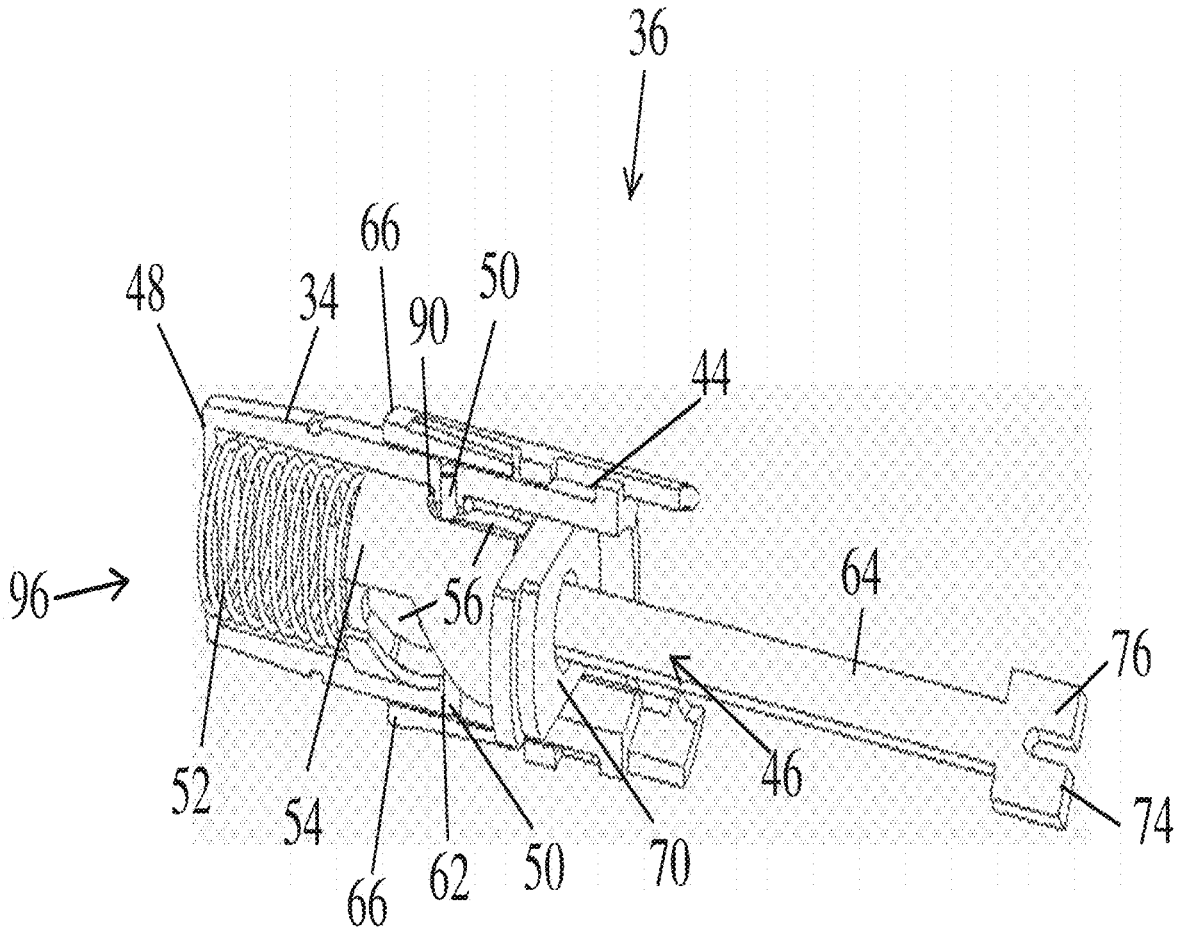
FIG. 12 is a partial cross sectional view of the push to lock and unlock cartridge and locking spindle as shown in FIG. 7 along line AA, showing the push button sectioned with the interior parts whole and the guide pin in the pocket of the cutout after the push button is depressed a first time.
Figure 16:
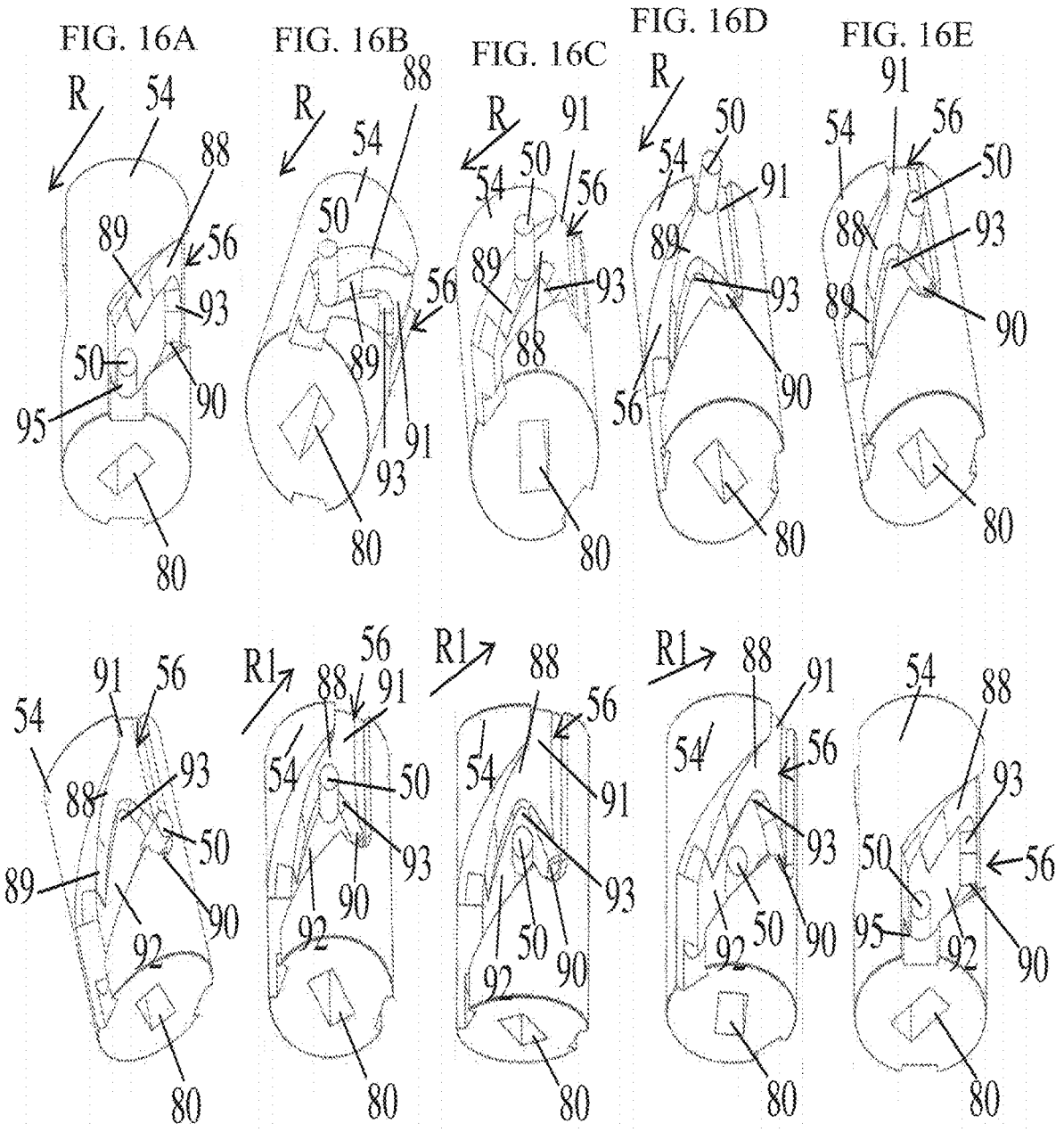
FIGS. 16A-J are a perspective view of a cam interacting with a retainer pin of the push to lock and unlock cartridge at various stages of operation.

After the push button 34 is released from the fully depressed position, as shown in FIG. 12, the spring 52 pushes the push button 34 slightly out of the central bore 46 until the retainer pins 50 fall into a pocket 90, better shown in FIGS. 16 and 17. As the spring 52 pushes the push button 34 back out of the central bore 46, the retainer pins fall into the pocket 90 in the cutout 56 which retains the push button 34 in the second extended position 96 as referenced in FIG. 3. The push button 34 is not in a state of rest as it is retained in the second extended position 96. The locking spindle 64 is also rotated and the cartridge 36 is retained in a locking position thus preventing rotation of both the interior side and exterior side door knobs 12, 15.

Figure 13:
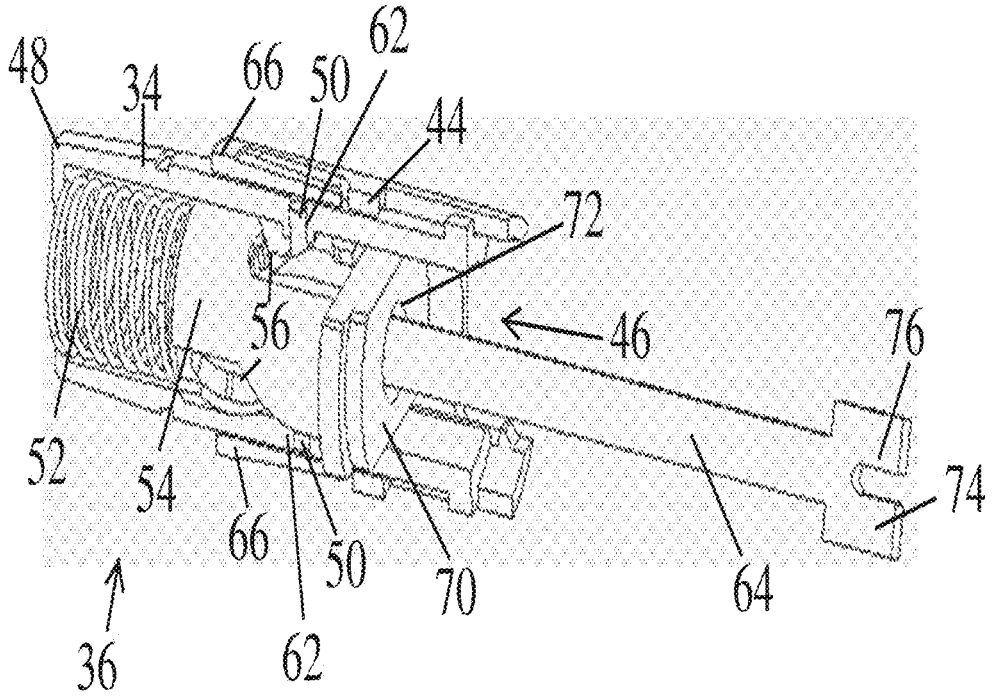
FIG. 13 is a partial cross sectional view of the push to lock and unlock cartridge and locking spindle as shown in FIG. 7 along line AA, showing the push button sectioned with the interior parts whole and the guide pin in a second pathway of the cutout as the push button is depressed a second time.
Figure 14:
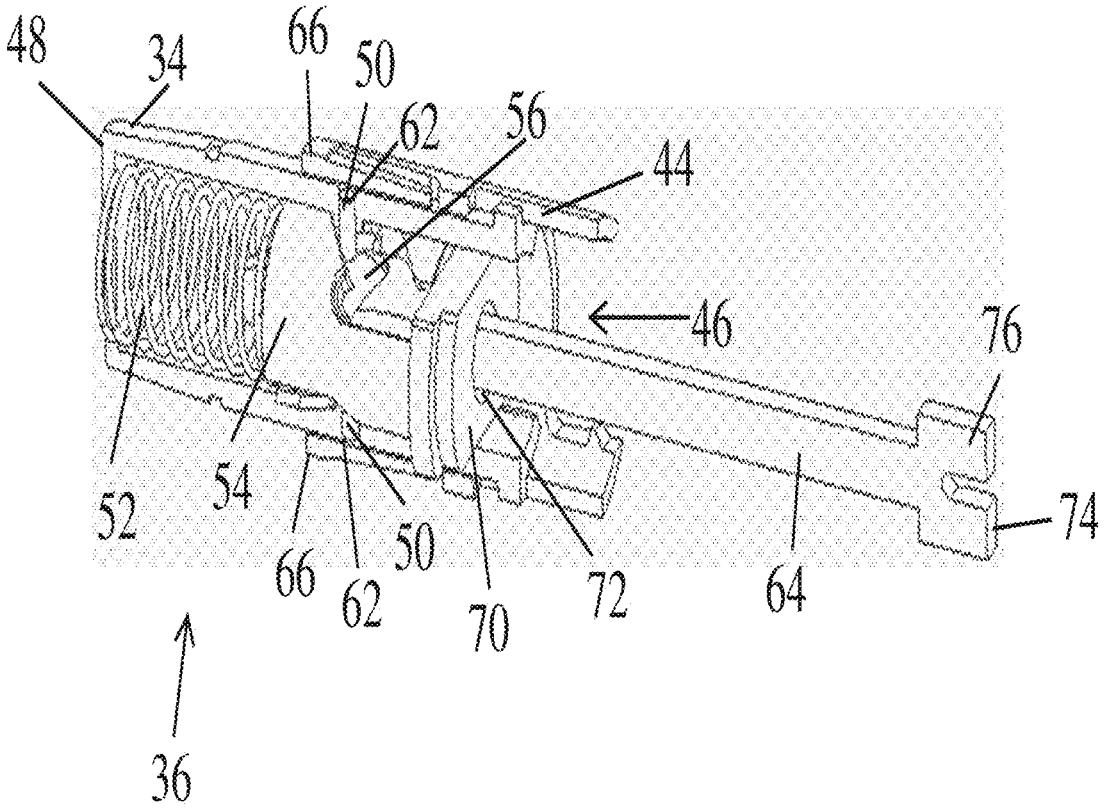
FIG. 14 is a partial cross sectional view of the push to lock and unlock cartridge and locking spindle as shown in FIG. 7 along line AA, showing the push button sectioned with the interior parts whole and the guide pin fully advanced down the second pathway of the cutout as the push button is depressed a second time.
Figure 15:
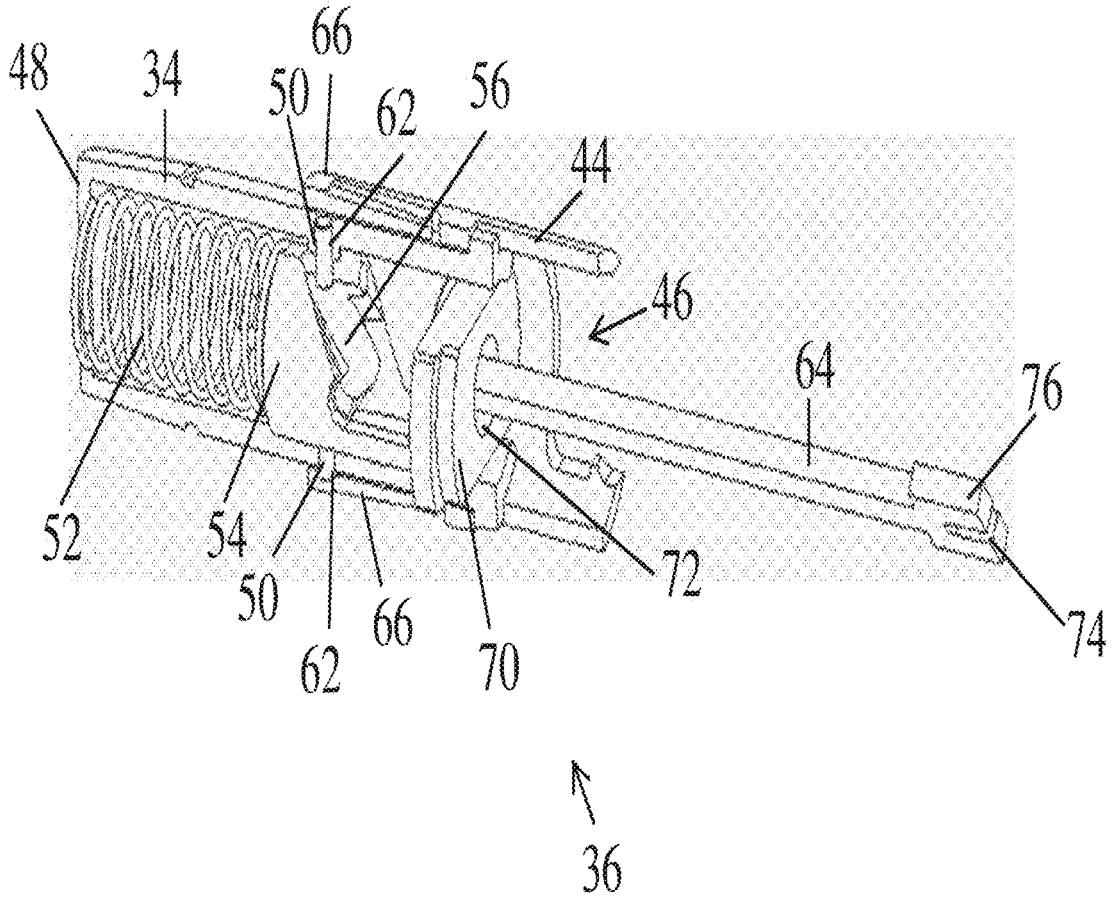
FIG. 15 is a partial cross sectional view of the push to lock and unlock cartridge and locking spindle as shown in FIG. 7 along line AA, showing the push button sectioned with the interior parts whole and the guide pin back in a home position of the cutout after the push button is depressed a second time.

In order to unlock the cartridge 36, the push button 34 is depressed again (following its second extended position 96 state referenced in FIG. 12), as shown in FIG. 13. Due to the curved nature of the of cutout 56, the retainer pins 50 cause the cam 54 to rotate in an opposite direction and thus rotates the locking spindle 64 in an opposite direction. The locking spindle 64 thereby begins to unlock the lock mechanism 30 (FIG. 3) as the cam 54 is rotated. FIG. 14 shows the progression of the rotating cam 54 that is rotated by the linear force of the spring 52 applying a force with the retainer pins 50 to the cutout 56. After the cam 54 is sufficiently rotated, both the interior and the exterior door knobs 12, 15 are free to rotate and the door is unlocked. FIG. 15, for example, shows the cartridge 36 back in the original first extended position 94 as discussed with respect to FIG. 3 and shown in FIG. 9.

The rotation of the cam 54 and interaction with the retainer pins 50 is shown in greater detail in FIGS. 16A-J. The progression of the cam's rotation is shown beginning with FIG. 16A where the push button 34 (not shown) is in the first extended position 94 as shown in FIGS. 9 and 15. As the push button 34 is depressed, the retainer pins 50 are moved along the cutout 56 of the cam 54 and encounter a ramp 89. Shown in FIG. 16B, the ramp 89 causes the cam 54 to rotate R as the retainer pins 50 exert a pressure on a first pathway 88. The cutout 56 is divided into two separate pathways, a first pathway 88 and a second pathway 92.

As the push button 34 is depressed, the retainer pins 50 are advanced further down the first pathway 88 as shown in FIG. 16C. Once the push button 34 is fully depressed into the depressed position 95 (see FIG. 3), the retainer pins 50 reach an end 91 of first pathway 88 as shown in in FIG. 16D. Once the user releases the manual pressure applied to the push button 34, the spring 52 extends the push button 34 to the second extended position 96 (see FIG. 3) and the retainer pins 50 move out of the end 91 of the first pathway 88 as shown in FIG. 16E and finally rest within the pocket 90 located in the second pathway 92 of the cutout 56 as shown in FIG. 16F. The pocket 90 retains the retainer pins 50 in place as the spring 52 shown in FIGS. 8-15 exerts a force on the push button 34 which is transferred to the retainer pins 50. The pocket 90 therefore catches the retainer pins 50 and keeps the push button 34 in the second extended position 96 shown in FIG. 3.

As shown in FIG. 16F, the cam 54 and retainer pins 50 are in the locked position with the push button 34 in the second extended position 96. In this state, both interior and exterior door knobs 12, 15 may not be rotated and the door remains locked.

In order to unlock the door, the user depresses the push button 34 a second time which advances the retainer pins 50 out of the pocket 90 and into a recess 93 as shown in FIG. 16G. The recess 93 prevents further forward motion of the retainer pins 50 and provides a hard stop when the user depresses the push button 34. Once the push button 34 is released from the manually applied depression, the spring 52 pushes the retainer pins 50 down the second pathway 92 as seen in FIG. 16H, which rotates the cam 54 in an opposite direction denoted by R'. Due to the curvature of the second pathway 92, the force of the spring 52 continues to move the retainer pins 50 down the second pathway 92, see FIG. 16I, rotating the cam 54 until it is back in the home position and the lock is unlocked as shown in FIG. 16G.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A method of operating a door lock comprising the steps of:

rotating one of a knob and a lever on one of an interior side or an exterior side of a door so as to retract a latch of the door;

pivoting the door to close the door, thereby aligning the latch with an opening in a strike mounted in a door frame;

releasing the one of the knob and the lever, thereby extending the latch into the opening of the strike in the door frame;

depressing a push-button lock mechanism a first time, thereby activating the door lock and preventing rotation of the one of the knob and the lever from both the interior side and the exterior side of the door; and depressing the push-button lock mechanism a second time, thereby deactivating the door lock and allowing rotation of the one of the knob and the lever on both the interior side and exterior side of the door to retract the latch from the opening of the strike in the door frame;

wherein neither rotation of the one of the knob and the lever on the interior side of the door nor rotation of the one of the knob and the lever on the exterior side of the door actuates the lock mechanism and does not deactivate the door lock.

2. The method according to claim 1, wherein the push button lock mechanism extends from an opening in the one of the knob and the lever.

3. The method according to claim 2, wherein rotating the one of the knob and the lever on either the interior or exterior side of the door does not depress the push button and does not release the push button.

4. The method according to claim 1, wherein the door lock is a cartridge configured for retrofitting with an existing door lock hardware.

5. The method according to claim 1, wherein the door lock is configured for a tubular style door lock.

6. The method according to claim 1, wherein actuating the push-button lock mechanism the first time prevents actuation of the latch and also prevents rotation of the one of the knob and the lever on both the interior side and the exterior side of the door.

7. A door lock comprising:

a lock cartridge within one of a door lever and a knob configured to engage the door lock and disengage the door lock with a manual depression;

a cylindrical body with a central bore configured to retain the door lock within the one of the door lever and the knob;

a push button with a closed end and an open end within the central bore of the cylindrical body configured for slidable engagement within the cylindrical body upon engagement by the manual depression on the closed end of the push button;

a spring in mechanical engagement with the push button configured to at least partially return the push button following the manual depression;

a cylindrical cam within the open end of the push button with a cutout along a side of the cylindrical cam;

a retainer pin passed through a retainer hole in the push button, thereby maintaining the retainer pin in a single location with respect to the push button, wherein the retainer pin also traverses within the cutout along the side of the cylindrical cam such that the retainer pin urges the cylindrical cam to rotate within the push button along the cutout as the cylindrical cam is displaced by the retainer pin;

a locking spindle in engagement with the cylindrical cam configured to rotate with the cylindrical cam, thereby selectively activating and deactivating the door lock as the locking spindle is rotated; and a detent tab contained within the push button and configured to maintain the cylindrical cam at a predetermined position within the push button such that the cylindrical cam is between the detent tab and the spring, wherein the locking spindle engages the cylindrical cam through an opening in the detent tab.

8. The door lock according to claim 7, further comprising a leaf spring incorporated on a side of the cylindrical body engaging the retainer pin with a pressure, thereby maintaining the retainer pin in positive engagement within the cutout of the cylindrical cam.

9. The door lock according to claim 7, wherein the locking spindle includes a forked end on a first side and an opposing side configured to interlock with a hole in the cylindrical cam, thereby rotating the locking spindle as the cylindrical cam is rotated.

10. The door lock according to claim 7, further comprising:

a first one of the lever and the knob associated with an opening on an interior side of a door, the push button protruding from the opening;

a second one of a lever and a knob on an exterior side of the door;

a latch in mechanical engagement with the first one of the lever and the knob and the second one of the lever and the knob configured to extend when the one of the lever and the knob on either the interior or exterior side of the door is in a neutral position and retract when the one of the lever and the knob on either the interior or exterior side of the door is in a rotated position; and wherein the one of the lever and the knob on both the interior side and the exterior side of the door is prevented from rotating when the door lock is activated.

11. The door lock according to claim 7, wherein the cutout of the cylindrical cam comprises:

a first pathway defining a route for the retainer pin to travel as the push button is manually depressed a first time, thus rotating the cylindrical cam;

a pocket within the first pathway to retain the retainer pin after displacement through the first pathway; and a second pathway defining a distinct route for the retainer pin to travel as the push button is manually depressed a second time, thus rotating the cylindrical cam in an opposing direction with respect to the first pathway;

wherein the lock cartridge is engaged following the first time the push button is manually depressed and the lock cartridge is disengaged following the second time the push button is manually depressed.

12. The door lock according to claim 11, wherein the locking spindle includes a forked end on a first side and an opposing side configured to interlock with a hole in the cylindrical cam, thereby rotating the locking spindle as the cylindrical cam is rotated.

13. The door lock according to claim 12, wherein the forked end of the locking spindle engages the one of the lever and the knob on an exterior side of a door and prevents the one of the lever and the knob on the exterior side of the door from rotating when the door lock is activated.

14. A door handle comprising:

a lock cartridge within the door handle configured to engage a locking mechanism and disengage the locking mechanism with a manual depression;

a cylindrical body with a central bore within the door handle configured to retain the lock cartridge;

a cylindrical push button with a closed end and an open end within the cylindrical body configured for slidable engagement within the cylindrical body upon engagement with the manual depression;

a spring in mechanical engagement with the cylindrical push button configured to return the cylindrical push button following the manual depression;

a cylindrical cam within the open end of the push button with a cutout along a side of the cylindrical cam;

a retainer pin passed through a retainer hole in the cylindrical push button, thereby maintaining the retainer pin in a fixed location with respect to the cylindrical push button, wherein the retainer pin is also passed into the cutout along the side of the cylindrical cam such that the retainer pin slides within the cutout and urges the cylindrical cam to rotate within the cylindrical push button as the cylindrical cam is displaced by the retainer pin;

a locking spindle in engagement with the cylindrical cam configured to rotate with the cylindrical cam, thereby selectively activating and deactivating the locking mechanism as the locking spindle is rotated; and a detent tab contained within the push button such that the cylindrical cam is between the detent tab and the spring, wherein the locking spindle engages the cylindrical cam through an opening in the detent tab;

the door handle comprising a first one of a lever and a knob with an opening on an interior side of a door, the cylindrical push button protruding from the opening; and the door handle comprising a second one of a lever and a knob on an exterior side of the door;

wherein the one of the lever and the knob on both the interior and the exterior sides of the door is prevented from rotating when the locking mechanism is activated.

15. The door handle according to claim 14, wherein the cylindrical push button is in a first extended position when the locking mechanism is activated and in a second extended position when the locking mechanism is deactivated, and wherein the second extended position is greater than the first extended position.

16. The door handle according to claim 14, wherein the locking spindle includes a forked end on a first side and an opposing side configured to interlock with a hole in the cylindrical cam, thereby rotating the locking spindle as the cylindrical cam is rotated.

17. The door handle according to claim 14, wherein a channel of the cylindrical cam comprises:

a first pathway defining a route for the retainer pin to travel as the cylindrical push button is manually depressed a first time, thus rotating the cylindrical cam;

a pocket within the first pathway to retain the retainer pin after displacement through the first pathway;

a second pathway defining a distinct route for the retainer pin to travel as the cylindrical push button is manually depressed a second time, thus rotating the cylindrical cam in an opposing direction with respect to the first pathway;

wherein the locking mechanism is engaged following the first time the cylindrical push button is manually depressed and the locking mechanism is disengaged following the second time the cylindrical push button is manually depressed.

* * * * *